United States Patent [19]

Connor

[11] 4,199,898

[45] Apr. 29, 1980

[54] CLOSURE APPARATUS WITH SNAP-IN SEAL STRIPS

[75] Inventor: Peter J. Connor, Bethlehem, Pa.

[73] Assignee: Mosser Industries, Inc., Bethlehem, Pa.

[21] Appl. No.: 24,073

[22] Filed: Mar. 26, 1979

[51] Int. Cl.[2] ..... E06B 7/098

[52] U.S. Cl. ..... 49/92; 49/488; 98/121 A; 137/601

[58] Field of Search ..... 49/91, 92, 483, 488, 49/489, 490, 499; 98/110, 121 A; 137/601

[56] References Cited

U.S. PATENT DOCUMENTS

| | | | |
|---|---|---|---|
| 1,398,284 | 11/1921 | Stickle | 49/499 X |
| 2,743,488 | 5/1956 | Thygeson | 49/488 X |
| 2,867,861 | 1/1959 | Pilson | 49/91 X |
| 3,530,783 | 9/1970 | Alamprese | 98/110 |
| 3,643,585 | 2/1972 | Barteleit et al. | 98/121 |
| 3,698,429 | 10/1972 | Lowe et al. | 137/601 |
| 3,885,347 | 5/1975 | Adachi et al. | 49/92 |

*Primary Examiner*—Kenneth Downey

*Attorney, Agent, or Firm*—Sutherland, Asbill & Brennan

[57] ABSTRACT

A snap-in metal strip, longitudinally bent into a V shape with the upper ends of both arms of the V being turned outward to the horizontal, thus creating longitudinal lips on the strip, is used to seal an elongate gap, for example a narrow space between adjacent, closed blades in a louver damper. The strip is releasably held on one side of the gap by means of two, opposed, crevice-like channels into which the lips of the strip fit.

18 Claims, 7 Drawing Figures

CLOSURE APPARATUS WITH SNAP-IN SEAL STRIPS

This invention relates to a mechanism for sealing an elongate gap between cooperating parts of a closure apparatus, at least one of which is a moving part. More particularly, it is directed to a snap-in type of flexible metal sealing strip, and means for mounting same.

Mechanical means for effecting fluid tight seals between moving parts of closure apparatus are used and required in all types of applications. Often what is sealed is an elongate gap existing between two members, at least one of which is a moving member carried by a frame. One example of such is a closure apparatus comprising a frame, a portion of which has a linear edge with a flat border, and a moving member carried by the frame, the moving member also having a linear edge with a flat border, in which apparatus the moving member is operable to be moved into a closed position with respect to the frame, but with an elongate gap left between the two linear edges.

Numerous different seal designs, of varying effectiveness, have been developed for sealing against leakage through such a gap. Flexible materials, such as strips of thin, spring tempered steel, are frequently used for this purpose, due to their ability to conform to irregularities in the surfaces bordering the gap. A problem with using flexible seals, however, is that they are easily damaged and may have to be frequently replaced. The effort required for replacement of the seals, which are often bolted or welded in place, can be substantial, translating into expensive down time and labor repair costs. It is an object of the present invention to provide a sealing means for such apparatus which is not only effective, but which can be repaired quickly and easily.

The sealing means of the present invention comprises means forming a first linear, crevice-like channel fixed to one of the two parts which border, and define, the elongate gap; means forming a second crevice-like channel generally facing, parallel to, and in substantially the same plane as, the first channel, but spaced apart therefrom; and an elongated, flexible metal strip, longitudinally bent so as to have a cross-section shaped like the letter V, but with the upper ends of both arms of the V being turned outward to the horizontal, thus creating longitudinal lips on the strip, the metal strip being releasably held in the crevice-like channels by insertion of one of the strip's longitudinal lips in one of the channels, and the other lip in the other channel, so as to position the V portion of the strip in the space between the two channels, the V pointing approximately perpendicular to the plane of the two channels, the channels and the strip being so positioned that one of the strip's surfaces defined by the arms of the V will be in sealing contact with a linear, flat-bordered edge of the other one of the two parts which border the elongate gap.

By the "plane" of a crevice-like channel is here meant the general direction, or lay, of the crevice.

The sealing means just described can be used for sealing an elongate gap between a moving member and a frame, or between two moving members mounted in a frame. It can be fixed either to a linear edge of a moving member, to a linear edge of a frame part, or to a flat wall portion of a frame.

There are three different elongate gaps that might be found in closure apparatus and which can be sealed by means of the present invention. The first of these is in a closure apparatus comprising a frame, a portion of which has a linear edge with a flat border (e.g., a flange around the inner periphery of the frame), and a moving member carried by the frame, the moving member also having a linear edge with a flat border, the moving member being operable to be moved into a closed position with respect to the frame, in which closed position an elongate gap exists between the two linear edges. There are two ways of sealing that gap by use of the present invention. The first way is to employ the combination of (a) means forming a first crevice-like channel fixed to the moving member at its linear edge and extending along that edge, the plane of the channel being substantially parallel to the flat border of the edge, and the opening of the channel facing away from the moving member and toward the elongate gap; (b) means forming a second crevice-like channel, connected to the first channel, the second channel generally facing, being parallel to, and being in substantially the same plane as, the first channel, but spaced apart therefrom by at least the width of the elongate gap; and (c) the aforedescribed elongated, flexible metal strip, the channels and the strip being so positioned that the strip's surface which faces away from the moving member will be in sealing contact with the linear edge of the frame when in the closed position.

The second manner of sealing the gap by means of the present invention differs from that just described only in that the channels and strip are mounted on the other side of the gap, that is, the channels and strip are fixed to the frame, rather than to the moving member. In that arrangement the first crevice-like channel is fixed to the frame at its linear edge and extends along that edge, the plane of the channel is substantially parallel to the flat border of the edge, and the opening of the channel faces away from the frame and toward the elongate gap. The second channel is attached to the first channel in the same manner as has been described, and the strip is likewise held by the two channels in the same way.

The second type of elongate gap which can be sealed by means of the present invention is that occuring in a closure apparatus comprising a frame, a first moving member carried by the frame, a portion of the first moving member having a linear edge with a flat border, and a second moving member carried by the frame, the second moving member also having a linear edge with a flat border, the moving members being operable to be moved into a closed position with respect to one another, in which closed position an elongate gap exists between the two linear edges. Sealing that gap is accomplished when practicing the present invention by use of (a) means forming a first crevice-like channel fixed to the first moving member at its linear edge and extending along the edge, the plane of the channel being substantially parallel to the flat border of the edge, and the opening of the channel facing away from the first moving member and toward the elongate gap; (b) means forming a second crevice-like channel connected to the first channel, the second channel generally facing, being parallel to, and being in substantially the same plane as, the first channel, but spaced apart therefrom by at least the width of the elongate gap; and (c) the aforedescribed metal strip, the channels and the strip being so positioned that the strip's surface which faces away from the first moving member will be in sealing contact with the linear edge of the second moving member when in the closed position.

The third type of elongate gap which can be sealed by means of the present invention is in a closure apparatus comprising a frame having a flat wall portion and a moving member carried by the frame, the moving member having a linear edge with a flat border, the moving member being operable to be moved into a closed position with respect to the frame, in which closed position the flat border of the edge of the moving member is substantially perpendicular to, but spaced apart from, the flat wall portion of the frame, thereby creating an elongate gap between the flat wall portion and the linear edge of the moving member. Sealing of that gap by means of the present invention involves the use of (a) means forming a first crevice-like channel fixed to the flat wall portion of the frame, the plane of the channel being generally parallel to the wall, and the opening of the channel being generally parallel to the linear edge of the closure member when in the closed position; (b) means forming a second crevice-like channel fixed to the wall, parallel to, and in substantially the same plane as, the the first channel, but spaced apart therefrom and (c) the aforedescribed flexible metal strip, the channels and the strip being so positioned and so dimensioned that one of the strip's V surfaces will be in sealing contact with the linear edge of the moving member when in the closed position.

The elongated (preferably rectangular) metal strip which is used to seal the gap between the cooperating members of the closure apparatus of the present invention can be formed of any metallic stock which will provide a surface for seating against a linear edge with a flat border, and which will resist corrosion in the environment of use and withstand the temperature of use. Thus, spring tempered metal is preferred, e.g., shim stock of stainless steel or other ferrous alloy. The metal strip should be made of material that is heavy enough to hold up under repeated opening and closing of the apparatus, yet thin enough, for example about 0.005 to 0.02 inch, to conform to surface irregularities of the linear, flat-bordered edge against which it seats.

Each of the two, crevice-like channels of the sealing means of the present invention should be wide enough and deep enough to receive the longitudinal lips of the flexible, V-shaped metal strip, leaving the V portion thereof protruding sideways from the space between the two channels. Various means can be used to form the crevice channels, and they need not be elaborate. For example, a single piece of elongated, rigid metal stock, appropriately bent along its length and welded to the linear edge or to the wall of the frame, will usually suffice. In one such embodiment, which is illustrated in the drawings accompanying this specification, the metal stock can be longitudinally bent so that its cross-section is the shape of a laterally compressed letter C and that will provide the pair of crevice-like channels.

The connection between the paired channels can be by direct or indirect attachment, so long as it serves to place the channels in fixed positions with respect to one another.

The dimensions of the V-shaped cross-section of the flexible metal strip should be such that the strip can be installed or removed from the channels simply by compressing its sides together, for example by finger pressure, and inserting it in, or withdrawing it from, the channels, one lip at a time. Therefore, the width of each lip on the metal strip is preferably no greater than the distance between the channel openings, otherwise it will be awkward to install and remove.

The cross-section of the flexible metal strip need not be a symmetrical V shape. It may be preferred, in fact, that the arms of the V be uneven in length, for example defining the hypotenuse and one other side of a right triangle. In the latter embodiment it is preferred that the channels and strip be positioned so that seating of the linear edge occurs against the hypotenuse, or long side, of the strip.

The channels and strip can be fixed to either one of the two flat surfaces which border the elongate gap. Where the two border surfaces lie in the same plane, it is preferred that the channels be so positioned that the V of the strip protrudes between the linear edges of the two surfaces, pointing in a direction substantially perpendicular to those surfaces.

The sealing means of the present invention is especially useful in a louver damper comprised of a rectangular frame with a fluid-flow opening therethrough; a plurality of elongated, rectangular louver blades rotatably mounted in the frame, the axis of rotation of each blade being parallel to the longitudinal edges of the blade; and means for simultaneously rotating the louver blades so as to move them between a damper-open position, where each blade is substantially parallel to the direction of fluid flow through the frame, and a damper-closed position, where the blades are aligned in a plane substantially perpendicular to the direction of fluid flow through the frame, the dimensions and location of the blades being such that, when in the damper-closed position, an elongate gap exists adjacent one or more of the longitudinal edges of the blades. The gap can be sealed by using the device of the present invention if the gap is either (a) between opposed longitudinal blade edges, (b) between a longitudinal blade edge and a flat portion of the inner wall of the frame, or (c) between a longitudinal blade edge and a seating flange on the inner wall of the frame, the flange being substantially perpendicular to the direction of fluid flow through the frame.

Frame, blades, and shafts may be fabricated out of any material, preferably metal, that is suitable for damper construction. Most often, however, it will be a ferrous alloy such as nickel-containing steel.

The shafts are preferably round. Each may be provided as one continuous shaft extending all the way across the frame, or it may be a pair of stub shafts journalled in opposite walls of the frame with their axes in alignment.

The invention will be better understood by viewing the drawings accompanying this specification, which illustrate some preferred embodiments of the seal arrangement of the present invention.

FIG. 1 of the drawings is a perspective few of a louver damper equipped with the sealing mechanism of the present invention, with the blades in the damper-open position.

FIG. 2 is an enlarged cross-sectional view of the damper shown in FIG. 1, partially broken away and taken along line 2—2 of FIG. 1, but with the blades in the damper-closed position.

FIGS. 3 and 4 are motion sequence views, further enlarged, of that portion of the damper depicted in FIGS. 1 and 2 where opposed blade edges meet. The broken lines in FIG. 4 illustrate the position occupied by sealing strip 10 prior to closing the damper.

Figure 1:
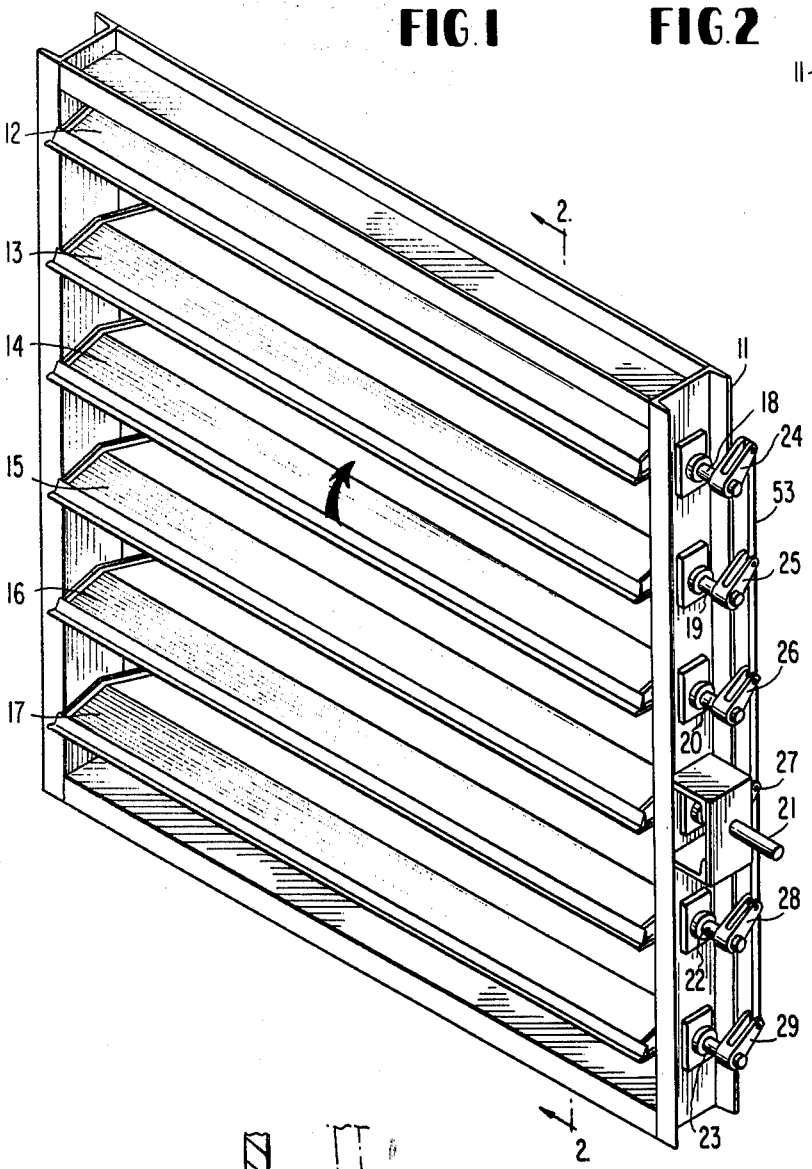

The louver damper depicted in the drawings is made up of a frame 11 and six louver blades 12, 13, 14, 15, 16, and 17. The louver blades are carried by shafts 18, 19, 20, 21, 22, and 23, which are journalled in frame 11 and pass through the wall thereof. Fixed to the ends of the shafts are clevises 24, 25, 26, 27, 28, and 29, which are pivotably pinned to connecting rod 53. Rotation of main shaft 21 causes clevis 27 to turn, which in turn moves connecting rod 20, causing blades 12 through 17 to rotate in unison.

Figure 2:
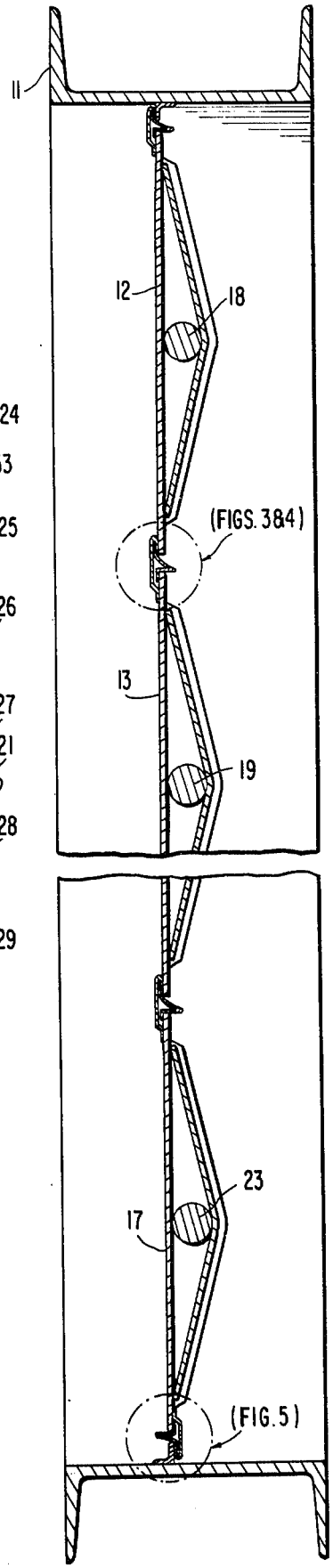
Figure 4:
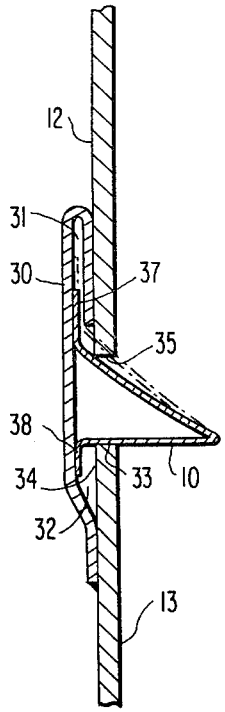

Blade 13 has a linear edge 33 with a flat border 34. Blade 12 has a linear edge 35 with a flat border 36. When the damper is in the closed position an elongate gap exists between edges 33 and 35. As shown in FIGS. 2 and 4, that gap is sealed by the mechanism of the present invention, which consists of track member 30 and flexible metal strip 10. The thickness of metal strip 10 is necessarily exaggerated in the drawings. In a preferred embodiment it would be only about 0.010 inch thick.

Track member 30 is an elongated piece of rigid metal that is welded to, and which extends along, the edge of blade 13. Track member 30 is longitudinally bent so as to form two, parallel, crevice-like channels 31 and 32. The opening of channel 32 faces away from the linear edge 33 of blade 13 and toward the elongate gap which exists between edge 33 and edge 35 when in the damper-closed position. Channel 31 faces channel 32, and both channels lay in substantially the same plane, which is parallel to the flat border 34 of edge 33. The width of the space between channels 31 and 32 is slightly greater than the width of the gap separating blade edges 33 and 35 when in the damper-closed position.

Metal strip 10 is longitudinally bent so as to have a cross-section shaped like the letter V, but with the upper ends of both arms of the V being turned outward to the horizontal, thus creating longitudinal lips 37 and 38 on the strip. The arms of strip 10 are unequal in length, so that a right triangle is defined by those arms plus the line of track member 30. Strip 10 is held in place by the insertion of lip 37 in channel 31 and lip 38 in channel 32. As shown in FIG. 4, it is the long arm of the V which seats against edge 35 of blade 12 when in the closed position.

Figure 5:
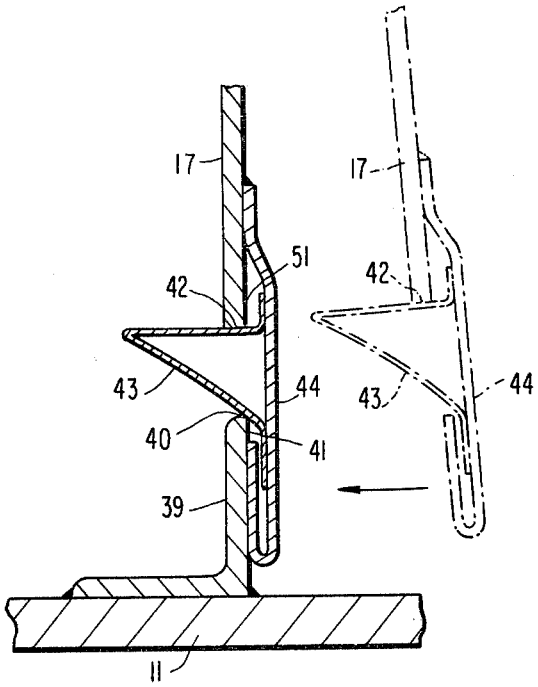
FIG. 5 is an enlarged view of the side seal arrangement shown in FIG. 2, with the broken line drawing again indicating position prior to closure.

As shown in FIGS. 2 and 5 of the drawings, on the inner wall of frame 11 is welded a flange member 39 which terminates in a linear edge 40 having a flat border 41. When the damper is in the closed position there is a gap between linear edge 40 of flange member 39 and linear edge 42 of blade 17, which has a flat border 51. That gap is sealed in the manner described above by operation of metal strip 43, which is held in place at edge 42 by track member 44, which is welded to blade 17.

Figure 6:
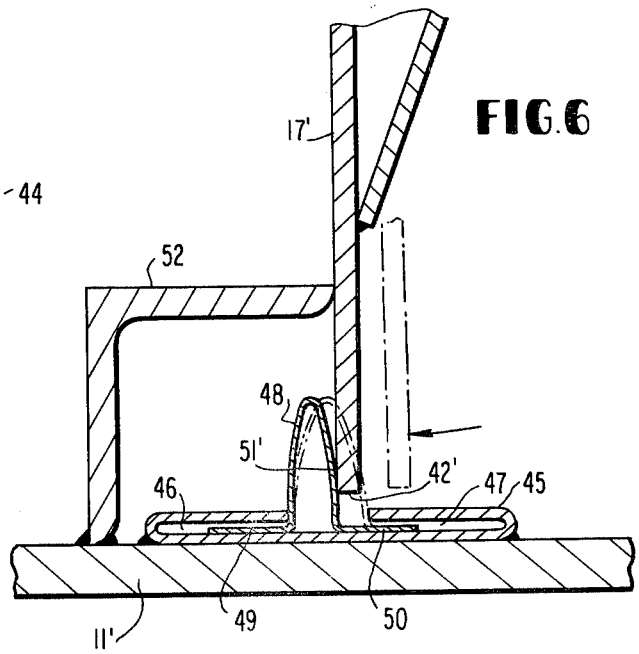

A first alternative arrangement for sealing the gap between the side blade and the interior wall of the frame of the damper depicted in the drawings is shown in FIG. 6. In that arrangement a track member 45, which in cross-section resembles a laterally compressed letter C, is welded to the inner wall of frame 11'. The configuration of track member 45 provides opposed, crevice-like channels 46 and 47. Flexible metal strip 48 is releasably held by track member 45 by virtue of the insertion of lip 49 of strip 48 into channel 46 and lip 50 of strip 48 into channel 47. The gap between edge 42' of blade 17' and the inner wall of frame 11' is sealed by the pressing contact of strip 48 against flat border 51' of blade 17'. Angle iron 52 is welded to the inner wall of frame 11' to provide a limit stop for blade 17'.

Figure 7:
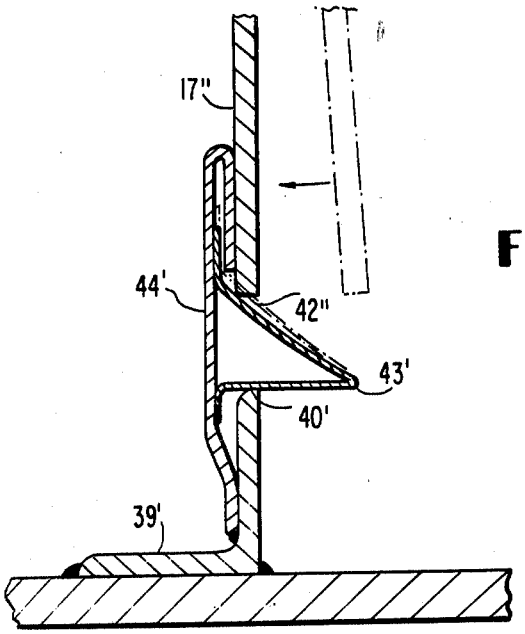
FIGS. 6 and 7 show two alternative forms of side seals to that depicted in FIG. 5.
Figure 3:
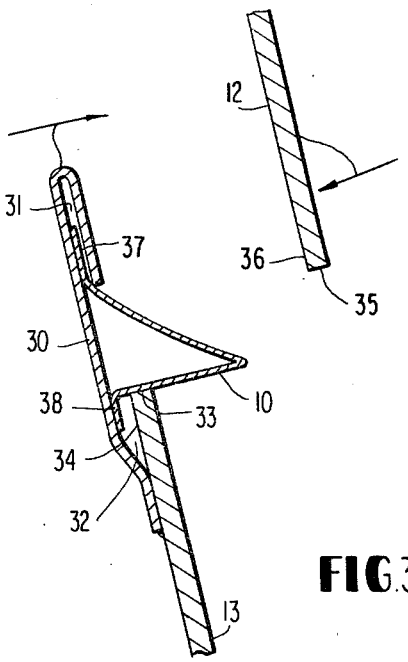

A second alternative sealing arrangement for the gap between the side blade and the frame wall of the damper depicted in the drawings is shown in FIG. 7. There the same parts are used as in the sealing arrangement illustrated in FIG. 5, except that the track member 44' is welded to the flange member 39' rather than to the blade 17''. Sealing of the gap between linear edge 42' of blade 17' and linear edge 40' of flange member 39' is effected by protrusion of metal strip 43' through the gap.

The foregoing description of the sealing means of the present invention has referred for illustrative purposes to some specific embodiments. Various changes in the form or arrangement of parts of those embodiments can be made without departing from the spirit or scope of the invention, and those will be readily apparent to workers skilled in this art.

I claim:

1. A closure apparatus comprising a frame, a portion of which has a linear edge with a flat border;

a moving member carried by the frame, the moving member also having a linear edge with a flat border, said moving member being operable to be moved into a closed position with respect to the frame, in which closed position an elongate gap exists between the two linear edges;

and means for sealing the gap between the two linear edges, said sealing means comprising (a) means forming a first crevice-like channel fixed to the moving member at its linear edge and extending along said edge, the plane of the channel being substantially parallel to the flat border of said edge, and the opening of the channel facing away from the moving member and toward said elongate gap; (b) means forming a second crevice-like channel connected to the first channel, the second channel generally facing, being parallel to, and in substantially the same plane as, the first channel, but spaced apart therefrom by at least the width of the elongate gap; and (c) an elongated, flexible metal strip, longitudinally bent so as to have a cross-section shaped like the letter V, but with the upper ends of both arms of the V being turned outward to the horizontal, thus creating longitudinal lips on the strip, said metal strip being releasably held in the crevice-like channels by insertion of one of the strip's longitudinal lips in each of the channels so as to position the V portion of the strip in the space between the two channels, the V pointing approximately perpendicular to the plane of the two channels, the channels and the strip being so positioned that the strip's surface which faces away from the moving member will be in sealing contact with the linear edge of the frame when in the closed position.

2. A closure apparatus comprising a frame;

a first moving member carried by the frame, a portion of the first moving member having a linear edge with a flat border;

a second moving member carried by the frame, the second moving member also having a linear edge with a flat border, said moving members being operable to be moved into a closed position with respect to one another, in which closed position an elongate gap exists between the two linear edges;

and means for sealing the gap between the two linear edges, said sealing means comprising (a) means forming a first crevice-like channel fixed to the first moving member at its linear edge and extending along said edge, the plane of the channel being substantially parallel to the flat border of said edge, and the opening of the channel facing away from the first moving member and toward said elongate gap; (b) means forming a second crevice-like channel connected to the first channel, the second channel generally facing, being parallel to, and being in substantially the same plane as, the first channel, but spaced apart therefrom by at least the width of the elongate gap; and (c) an elongated, flexible metal strip, longitudinally bent so as to have a cross-section shaped like the letter V, but with the upper ends of both arms of the V being turned outward to the horizontal, thus creating longitudinal lips on the strip, said metal strip being releasably held in the crevice -like channels by insertion of one of the strip's longitudinal lips in each of the channels so as to position the V portion of the strip in the space between the two channels, the V pointing approximately perpendicular to the plane of the two channels, the channels and the strip being so positioned that the strip's surface which faces away from the first moving member will be in sealing contact with the linear edge of the second moving member when in the closed position.

3. A closure apparatus comprising a frame, a portion of which has a linear edge with a flat border;

a moving member carried by the frame, the moving member also having a linear edge with a flat border, said moving member being operable to be moved into a closed position with respect to the frame, in which closed position an elongate gap exists between the two linear edges;

and means for sealing the gap between the two linear edges, said sealing means comprising (a) means forming a first crevice-like channel fixed to the frame at its linear edge and extending along said edge, the plane of the channel being substantially parallel to the flat border of said edge, and the opening of the channel facing away from the frame and toward said elongate gap; (b) means forming a second crevice-like channel connected to the first channel, the second channel generally facing, being parallel to, and being in substantially the same plane as, the first channel, but spaced apart therefrom by at least the width of the elongate gap; and (c) an elongated, flexible metal strip, longitudinally bent so as to have a cross-section shaped like the letter V, but with the upper ends of both arms of the V being turned outward to the horizontal, thus creating longitudinal lips on the strip, said metal strip being releasably held in the crevice-like channels by insertion of one of the strip's longitudinal lips in each of the channels so as to position the V portion of the strip in the space between the two channels, the V pointing approximately perpendicular to the plane of the two channels, the channels and the strip being so positioned that the strip's surface which faces away from the frame will be in sealing contact with the linear edge of the moving member when in the closed position.

4. The apparatus of claims 1, 2, or 3, wherein the metal strip is spring tempered steel, and the width of each lip on the strip is no greater than the distance between the two channels in which the strip is held.

5. The apparatus of claims 1, 2, or 3, wherein the moving member is an elongated, rectangular louver blade which is rotatably mounted in the frame, the axis of rotation of the blade being parallel to the longitudinal edges of the blade.

6. The apparatus of claims 1, 2, or 3, wherein the metal strip is spring tempered steel about 0.005 to 0.02 inch thick, the width of each lip on the strip is no greater than the distance between the two channels in which the strip is held, and the moving member is an elongated, rectangular louver blade which is rotatably mounted in the frame, the axis of rotation of the blade being parallel to the longitudinal edges of the blade.

7. The apparatus of claims 1, 2, or 3, wherein the metal strip is spring tempered steel about 0.005 to 0.02 inch thick, the arms of the cross-sectional V of the strip are unequal in length so that the arm which is in sealing contact constitutes the hypotenuse of a right triangle defined by the V, the width of each lip on the strip is no greater than the distance between the two channels in which the strip is held, and the moving member is an elongated, rectangular louver blade which is rotatably mounted in the frame, the axis of rotation of the blade being parallel to the longitudinal edges of the blade.

8. A louver damper comprised of a rectangular frame with a fluid flow opening therethrough;

a seating flange on the inner wall of the frame in a plane which is substantially perpendicular to the direction of fluid flow through the frame;

a plurality of elongated, rectangular louver blades rotatably mounted in said frame, the axis of rotation of each blade being parallel to the longitudinal edges of the blade;

means for simultaneously rotating said louver blades so as to move them between a damper-open position, where each blade is substantially parallel to the direction of fluid flow through the frame, and a damper-closed position, where the blades are aligned in a plane substantially perpendicular to the direction of fluid flow through the frame, the dimensions and location of the blades being such that, when in the damper-closed position, an elongate gap exists between a first longitudinal edge of one of the blades and the seating flange;

means forming a first crevice-like channel fixed to said first longitudinal blade edge, the plane of the channel being substantially parallel to the flat border of said edge, and the opening of the channel facing away from the blade and toward said elongate gap;

means forming a second crevice-like channel connected to the first channel, the second channel generally facing, being parallel to, and being in substantially the same plane as, the first channel, but spaced apart therefrom by at least the width of the elongate gap;

and an elongated, flexible metal strip, longitudinally bent so as to have a cross-section shaped like the letter V, but with the upper ends of both arms of the V being turned outward to the horizontal, thus creating longitudinal lips on the strip, the width of each lip being less than the distance between the two channels, said metal strip being releasably held in the crevice-like channels by insertion of one of the strip's longitudinal lips in each of the channels so as to position the V portion of the strip in the space between the two channels, the V pointing approximately perpendicular to the plane of the two channels, the channels and the strip being so positioned that the strip's surface which faces away from the blade will be in sealing contact with the edge of the seating flange when in the damper-closed position.

9. The damper of claim 8 wherein the louver blades are so dimensioned that an elongate gap exists between the opposed longitudinal edges of at least one pair of adjacent blades when in the damper-closed position, and the damper includes means forming a first crevice-like channel fixed to a first one of said opposed longitudinal blade edges, the plane of the channel being substantially parallel to the flat border of said edge, and the opening of the channel facing away from the blade and toward said elongate gap; means forming a second crevice-like channel connected to the first channel, the second channel generally facing, being parallel to, and being in substantially the same plane as, the first channel, but spaced apart therefrom by at least the width of the elongate gap; and an elongated, flexible metal strip, longitudinally bent so as to have a cross-section shaped like the letter V, but with the upper ends of both arms of the V being turned outward to the horizontal, thus creating longitudinal lips on the strip, the width of each lip being less than the distance between the two channels, said metal strip being releasably held in the crevice-like channels by insertion of one of the strip's longitudinal lips in each of the channels so as to position the V portion of the strip in the space between the two channels, the V pointing approximately perpendicular to the plane of the two channels, the channel and the strip being so positioned that the strip's surface which faces away from the first opposed blade will be in sealing contact with the longitudinal edge of the second opposed blade when in the damper-closed position.

10. The damper of claim 9 wherein the metal strip is spring tempered steel.

11. The damper of claim 9 wherein the metal strip is about 0.005 to 0.02 inch thick.

12. The damper of claim 10 wherein the metal strip is about 0.005 to 0.02 inch thick.

13. The damper of claims 8, 9, or 12, wherein the rotation means simultaneously rotate all of the louver blades in the same direction.

14. A closure apparatus comprising a frame having a flat wall portion;

a moving member carried by the frame, the moving member having a linear edge with a flat border, said moving member being operable to be moved into a closed position with respect to the frame, in which closed position the flat border of the edge of the moving member is substantially perpendicular to, but spaced apart from, the flat wall portion of the frame, thereby creating an elongate gap between the flat wall portion and the linear edge of the moving member;

and means for sealing said elongate gap, said sealing means comprising (a) means forming a first crevice-like channel fixed to the flat wall portion of the frame, the plane of the channel being generally parallel to the wall, and the opening of the channel being generally parallel to the linear edge of the closure member when in the closed position; (b) means forming a second crevice-like channel fixed to the wall, parallel to, and in substantially the same plane as, the first channel, but spaced apart therefrom and (c) an elongated, flexible metal strip, longitudinally bent so as to have a cross-section shaped like the letter V, but with the upper ends of both arms of the V being turned outward to the horizontal, thus creating longitudinal lips on the strip, the width of each lip being less than the distance between the two channels, said metal strip being releasably held in the crevice-like channels by insertion of one of the strip's longitudinal lips in each of the channels so as to position the V portion of the strip in the space between the two channels, the V pointing approximately perpendicular to the plane of the two channels, the channels and the strip being so positioned and so dimensioned that one of the strip's V surfaces will be in sealing contact with the linear edge of the moving member when in the closed position.

15. The apparatus of claim 14, wherein the metal strip is spring tempered steel.

16. The apparatus of claim 14, wherein the moving member is an elongated, rectangular louver blade which is rotatably mounted in the frame, the axis of rotation of the blade being parallel to the longitudinal edges of the blade.

17. The apparatus of claim 14, wherein the metal strip is spring tempered sheet steel about 0.005 to 0.02 inch thick and the moving member is an elongated, rectangular louver blade which is rotatably mounted in the frame, the axis of rotation of the blade being parallel to the longitudinal edges of the blade, and the elongate gap in the closed position existing between one of the longitudinal edges of the blade and the interior wall of the frame.

18. The apparatus of claims 14, 16, or 17, wherein the means forming the first and second channels is an elongated strip of rigid metal, longitudinally bent so as to have a cross-section shaped like a laterally compressed letter C.

* * * * *